US006010172A

United States Patent [19]

Comeau

[11] Patent Number: 6,010,172

[45] Date of Patent: Jan. 4, 2000

[54] IN-LINE SKATE CARRIER

[76] Inventor: Victor J. Comeau, 123 Quinnipiac Ave., North Haven, Conn. 06473

[21] Appl. No.: 09/217,738

[22] Filed: Dec. 21, 1998

[51] Int. Cl.[7] ..... A45F 5/10; B65D 71/00

[52] U.S. Cl. ..... 294/163; 294/148; 294/165

[58] Field of Search ..... 294/137, 146–148, 294/151, 159, 162, 163, 165–169; 12/120.5; 206/315.1; 211/34, 37, 38; 280/809, 811, 814

[56] References Cited

U.S. PATENT DOCUMENTS

| | | | |
|---|---|---|---|
| D. 352,173 | 11/1994 | Tirone et al. . | |
| 2,353,809 | 7/1944 | Carson . | |
| 3,412,866 | 11/1968 | Binding . | |
| 3,775,794 | 12/1973 | Fisher . | |
| 3,775,956 | 12/1973 | Jung . | |
| 4,269,337 | 5/1981 | Sobotka | 294/163 |
| 4,326,746 | 4/1982 | Grihalva | 294/162 X |
| 4,624,496 | 11/1986 | Bengtson | 294/163 X |
| 4,761,029 | 8/1988 | Woodcock | 294/163 X |
| 5,269,580 | 12/1993 | Hsiao . | |
| 5,547,157 | 8/1996 | Hsiao . | |
| 5,611,427 | 3/1997 | Bigham . | |
| 5,709,425 | 1/1998 | Cordova . | |

*Primary Examiner*—Johnny D. Cherry
*Attorney, Agent, or Firm*—DeLio & Peterson LLC

[57] ABSTRACT

A carrier for in-line-skates is provided comprising a substantially rectangular base support, skate retaining side wall members extending partially around the periphery of the base support and a skate retaining rear member to provide a three-sided structure open at the front of the base to hold a pair of skates in an upright position in a side-by-side relationship. When the skates are placed on the base in an upright position they will be in a side-by-side relationship and a connection member attached to one side wall member is drawn across the boot part of the skates to the other side member and attached thereto to secure the skates in the carrier in the upright position. The carrier is transported by hand using a handle positioned in one or more of the side members or preferably to the rear member. Longitudinal and transverse upwardly extending groove forming members are preferably on the surface of the base member to hold the wheels in a somewhat fixed position.

7 Claims, 1 Drawing Sheet

IN-LINE SKATE CARRIER

BACKGROUND OF THE INVENTION

1. Field of the Invention

This invention relates generally to a carrier for boots, and, in particular, to a carrier for in-line skates which is inexpensive to make and easy to use and store by the wearer of the skates.

2. Description of Related Art

Boots including boot type skates such as ice skates, roller skates, in-line skates and the like necessarily come in pairs and are used as a pair by the wearer. The handling and/or transporting of the boots is awkward, however, and, in general, the boots are either held in separate hands or held together resulting in swinging of the boots, scratching of the boots as they rub together and possibly damage to the boot especially if placed or dropped on the ground.

For convenience, the following description will be directed to in-line skate carriers and in-line skates although it will be appreciated by those skilled in the art that the carrier would be able to be used for other boots as described above.

In-line skating has become a very popular sport. In-line skates however, are bulky and difficult to handle when not skating. Basically, in-line skates comprise a boot wherein the sole is connected to an inverted channel-shaped blade. Three or more roller wheels are rotatably-mounted in-line partially within the channel-shaped member so that the wheels touch the ground when being worn by the skater and the wheels rotate during motion of the skater. Accordingly, when not being worn, the in-line skates are inherently unstable in the upright position.

A number of patents have issued for in-line skate and other boot carriers which facilitate holding and carrying the in-line skates. U.S. Pat. No. 5,269,580 to Hsiao shows an in-line skate carrier comprising a body having two laterally spaced pockets each having side supports dimensioned to engage opposite sides of the skate channel to hold the boots side-by-side and having a hook to hook around one of the rollers (preferably the forward-most roller). The forward ends of the pocket-forming portions are connected by a transverse member to which a carrying handle is attached.

U.S. Pat. No. 5,611,472 to Bigham discloses an apparatus for carrying in-line skates comprising a base member having a front, back and bottom. The base member defines first and second slots, each open to the bottom and extending from the front to the back. The first and second slots are each sized to receive the blade of an in-line skate so that the base member is substantially perpendicular to the in-line skate blades.

U.S. Pat. No. 5,709,425 to Cordova shows a carrier for skates and other articles comprising an elongate upstanding member. The structure on a lower end of the elongate upstanding member is for holding a pair of skates and other articles in a side-by-side hang down relationship. A hook on the upper end of the elongated upstanding member is for grasping by a hand of a person to transport a pair of skates or for hanging the carrier on a pole in a closet.

U.S. Pat. No. 3,775,794 to Fisher shows a ski boot holder comprising a pair of hollow frames with the first frame fitted over the toe end of the ski boots and a wall of a second frame extending through the first frame and which is moved behind the boot. Both frames extend around the boots with the free end of the second frame forming a handle for carrying the boots. U.S. Pat. No. 3,777,956 to Jung is a roller skate carrier comprising a base bar adapted to engage with the interconnecting straps of a pair of roller skates. Design Pat. No. 352,173 to Tirone et al. shows an ornamental design for a holder for in-line skates.

Bearing in mind the problems and deficiencies of the prior art, it is therefore an object of the present invention to provide a carrier for boots and boot type skates including ice skates, roller skates, in-line skates and the like.

It is another object of the present invention to provide a carrier for in-line skates wherein the skates are held securely side-by-side in the carrier in an upright position.

A further object of the invention is to provide an in-line skate carrier which is inexpensive and easy to use and store by the wearer of the in-line skates.

Other objects and advantages of the present invention will become apparent from the following detailed description.

SUMMARY OF THE INVENTION

The above and other objects and advantages, which will be apparent to one of skill in the art, are achieved in the present invention which is directed in a first aspect to a carrier for in-line skates comprising a boot portion and a wheel portion comprising:

- a preferably planar substantially rectangular base member having a front, a back and opposed sides to support two skates in a substantially upright position in a side-by-side relationship;
- skate retaining side walls connected to the base at opposed sides of the base;
- a skate retaining rear wall connected to the rear of the base and forming a three-sided structure with the side walls, which structure is open at the front end of the base;
- connection means connecting the side walls to secure the skates in the carrier, one end of the connection means preferably fixedly secured to one of the side walls by a clamp or other locking means and the other free end of the connection means secured to the other side wall by a clamp or other locking means to secure the skates in the carrier when the skates are placed on the base with the front end (toe portion) of the skates facing the front end of the base and the rear (heel portion) of the skates held against the rear member and with the skates being upright on the base and positioned between the side walls; and
- handle means on one or more of the side walls or rear wall for carrying the skates secured in the carrier.

In another aspect of the invention, the side walls and rear wall may be made as a single unit and secured around three sides of the base forming the in-line skate carrier. In another aspect, the base is formed having a peripheral upwardly extending flange, preferably U-shaped, to facilitate securing the side walls and rear wall to the base.

In a further aspect of the invention the base member has a plurality, e.g., four, elongated longitudinal protrusions extending upward from the base forming two channels so that the wheels of each in-line skate are positioned in each of the channels. The channels preferably have a plurality of transverse protrusions to provide a stop for longitudinal movement of the skate wheels in the carrier.

In another aspect of the invention, the rear wall of the carrier has openings therein to accommodate a brake on the in-line skate, the brake normally being attached at the heel portion of the skate on at least one of the skates. The brake normally extends and protrudes past the heel portion of the skate and extends into the opening in the rear wall when the skate is secured in the carrier.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENTS

Figure 1:
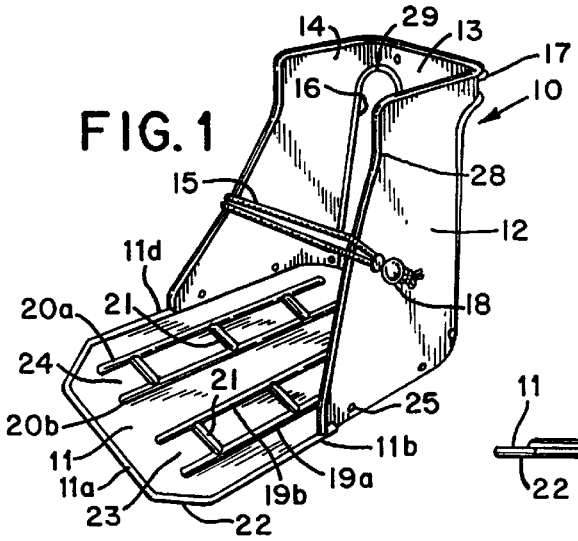
FIG. 1 is a perspective view of an in-line skate carrier of the invention.

In describing the preferred embodiment of the present invention, reference will be made herein to FIGS. 1–7 of the drawings in which like numerals refer to like features of the invention. Features of the invention are not necessarily shown to scale in the drawings.

Figure 4:
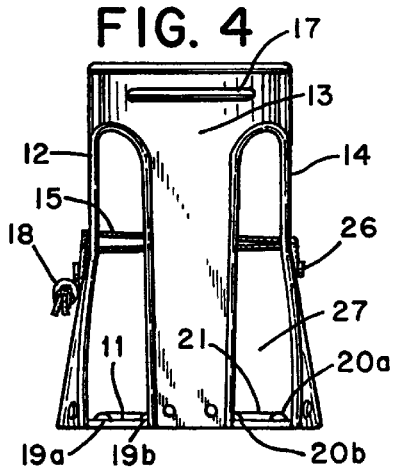
FIG. 4 is a back view of the in-line skate carrier of FIG. 1.

Referring to FIG. 1, an in-line skate carrier of the invention is shown generally as 10. The carrier 10 has a generally rectangular base 11 having a front 11*a*, sides 11*b* and 11*d* and a rear. The front 11*a* is preferably angled to avoid sharp edges which could cause injury. The base is of a length and width sufficient to accommodate and support the boot and wheels of a pair of in-line skates in side-by-side position. Attached from about the middle of sides 11*b* and 11*d* to the rear of base 11 are opposed side wall members 12 and 14 and rear member 13 shown as a preferred integral one-piece assembly. Side wall members 12 and 14 are shown in a downwardly angled shape with the wall being longer at the base than at the top of the wall. Rear wall 13 is shown having spaced vertical openings 27 as shown in FIG. 4. The vertical openings 27 accommodate a braking mechanism on the in-line skate, which braking mechanism is typically attached at the heel portion of the skate on at least one of the skates and extends past the heel portion. The braking mechanism preferably extends through the opening.

The side wall members 12 and 14 and rear member 13 are typically secured to the base by fasteners 25 such as pop rivets. Preferably, the base member 11 has an upward extending flange (shown as 27 in FIG. 5) to which the side members and rear member are fastened. A handle 17 is shown attached to rear member 12 and is used to carry the in-line skate carrier.

The edges of the base 11, side walls 12 and 14 and rear wall 13 have a molding 22, 28 and 29 secured thereto forming a lip. In another embodiment, the base 11 is made with a peripheral upwardly extending flange to which the side walls 12 and 14 and rear wall 13 are secured. The remainder of the peripheral flange not used to secure the side walls and rear wall is removed and the molding secured to the edge of the base.

Elongated longitudinal raised members 19*a* and 19*b* and 20*a* and 20*b* are shown on the upper surface of base 11 forming two grooves 23 and 24 to accommodate the wheels of each in-line skate. The elongated members preferably extend from proximate the front 11*a* of base 11 to proximate the rear of base 11. These elongated members form a groove or channel 23 and 24 to accommodate the wheels of the skate and provide lateral support for the wheels. Transverse raised ribs 21 are shown extending between the elongated members to prevent the skates from moving forward in the carrier. It is preferred that the transverse ribs intersect the longitudinal members.

Figure 3:
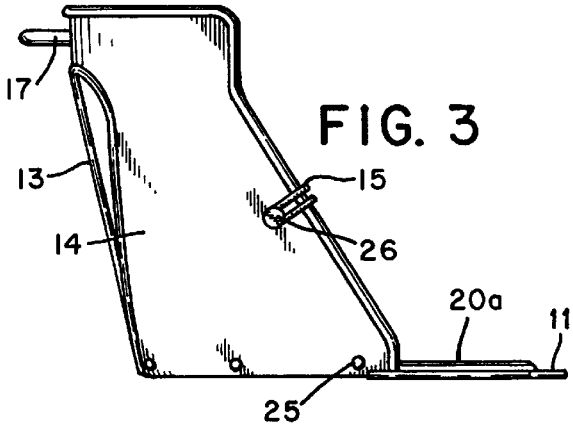
FIG. 3 is a left elevational side view of the in-line skate carrier of FIG. 1.

To secure the in-line skates in the carrier 10, a strap 15 extending across the base 11 is secured to side members 12 and 14. The strap is long enough to extend across the width of base 11 and is secured at the free end of strap 15 to a locking device 18. The locking device is shown as a knob over which a loop in the strap 15 is positioned. The strap is typically of a resilient and/or flexible material such as nylon and the strap clamping mechanism 26 (as shown in FIG. 3) and locking device 18 may be Velcro or other such clamping means such as a buckle. Strap clamping mechanism 26 for side wall 14 is shown as a knob as for locking device 18 on side wall 12.

Figure 2:
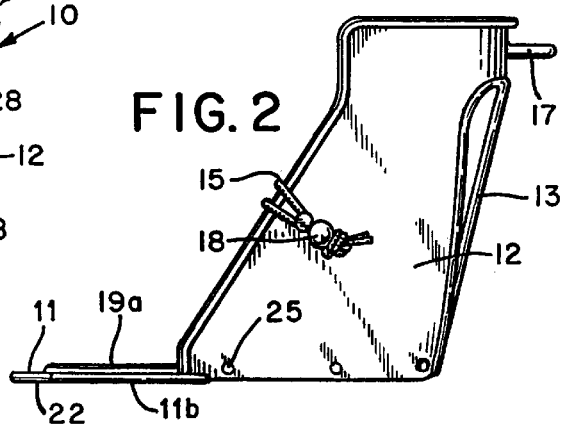
FIG. 2 is a right elevational side view of the in-line skate carrier of FIG. 1.

Referring to FIG. 2, side wall 12 is shown angled downwardly and locking mechanism 18 is shown near the edge of the side wall and at about the middle of side wall 12 and is used to secure strap 15 to the side wall. This position is about at the arch or leg portion of the boot of the in-line skate. FIG. 3 shows a left side view of the in-line skate carrier and shows side wall 14. Strap 15 is shown connected to side wall 14 at strap clamping mechanism 26 which is also near the edge and about at the middle of the side wall. The strap when secured preferably crosses the arch or leg portion of the boot.

FIG. 4 shows a back view of the in-line skate carrier of FIG. 1. Handle 17 is shown at the upper end of rear member 13 and provides a handle for carrying the in-line skate carrier. Openings 27 in rear member 13 accommodate a braking mechanism on the heel portion of the in-line skate.

Figure 5:
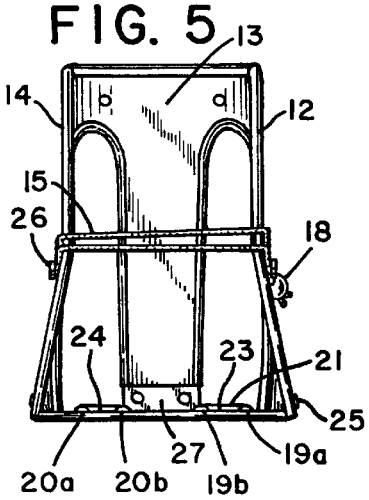
FIG. 5 is a front view of the in-line skate carrier of FIG. 1.

A front view of the in-line skate carrier is shown in FIG. 5. Side walls 12 and 14 are shown connected to base member 11 as is rear wall 13 connected to flange 27. Similar flanges, not shown, would be used to secure side walls 12 and 14 to the base 11. Elongated members 19*a* and 19*b*, and 20*a* and 20*b* are shown protruding upward from the upper surface of base 11 forming grooves 23 and 24, respectively.

Figure 6:
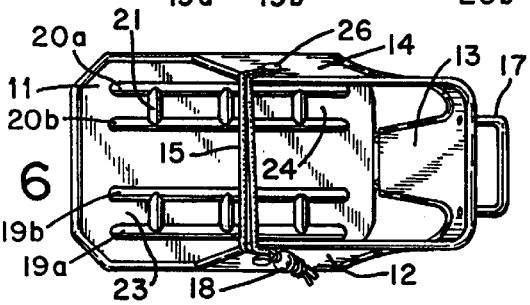
FIG. 6 is a top plan view of the in-line skate carrier of FIG. 1.

Referring to FIG. 6, side walls 12 and 14 in combination with integral rear member 13 are shown forming an open structure at the front end 11*a* of base 11. Elongated members 19*a* and 19*b* and 20*a* and 20*b* are shown extending the length of base 11 forming grooves 23 and 24, respectively, in which the wheels of each skate are positioned. Strap 15 is shown extended from side wall 14 and secured to side wall 12. Handle 17 is shown attached to rear wall 12.

Figure 7:
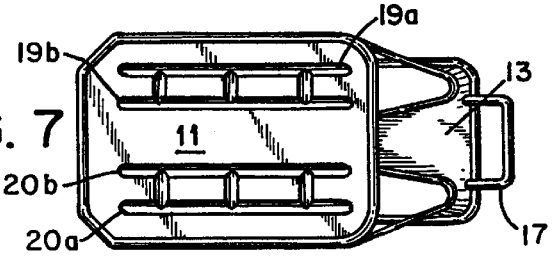
FIG. 7 is a bottom view of the in-line skate carrier of FIG. 1.

FIG. 7 shows the bottom view of the in-line-skate carrier of FIG. 1 with side walls 12 and 14 and rear wall 13 connected to base 11. The lower sides of elongated members 19*a*, 19*b*, 20*a* and 20*b* are shown as indented in the base 11. Generally, and preferably, the base is formed of a single molded plastic wherein the members 19*a*, 19*b*, 20*a* and 20*b* are formed as raised on the upper surface of base 11 and correspondingly indented on the lower surface of base 11.

The base member 11, side wall members 12 and 14 and rear wall 13 are preferably made of a rigid strong material such as plastic by any of a variety of molding methods such as injection molding. Elongated members 19*a*, 19*b*, 20*a* and 20*b* may likewise be made separately of a strong rigid material such as plastic and secured to the base. Preferably, as noted above, the base member 11 is formed as a single piece by injection molding with the raised portions of the elongated member 19*a*, 19*b*, 20*a* and 20*b* being indented on the lower surface of the base. The base may of course be formed with the protrusions being solid and the lower surface of the base planar and not indented. Any plastic may be used which is durable and which would withstand a shock such as bumping or dropping of the skate carrier on the ground. A preferred plastic material is ABS (acrylonitrile-butadiene-styrene copolymer). Generally, the thickness of the plastic material is sufficient to provide a durable in-line-skate carrier. For a plastic material such as ABS, the thickness of the base is about 0.1 inch and the thickness of the wall and rear member 0.08 inch. The elongated members 19*a*, 19*b*, 20*a* and 20*b* may also be made of metal and secured to base 11 to provide increased strength for the in-line skate carrier.

The strap 15 is generally of a resilient and/or flexible material such as elastic, nylon and the like. One end is typically fixedly secured to one of the side walls and the free end of the strap has a clasping mechanism (such as a loop) which is secured to a locking mechanism such as a knob on the other side wall. Another clasping mechanism is Velcro.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A carrier for in-line skates having a boot portion and a wheel portion comprising:

a planar substantially rectangular base member having a front, a back and opposed sides to support two skates in a substantially upright position in a side-by-side relationship;

skate retaining side members connected to the base at opposed sides of the base;

a skate retaining rear member connected to the rear of the base and forming a three-sided structure with the side members, which structure is open at the front end of the base;

connection means connecting the side members to secure the skates in the carrier, one end of the connection means secured to one of the side members by a clamp or other locking means and the other free end of the connection means secured to the other side member by a clamp or other locking means to secure the skates in the carrier when the skates are placed on the base with the front end of the skates facing the front end of the base and the rear of the skates held against the rear member and with the skates being upright on the base and positioned between the side members; and handle means on one or more of the side members or rear member for carrying the skates secured in the carrier.

2. The carrier of claim 1 wherein the side walls extend from about the middle of the base member to the rear of the base member.

3. The carrier of claim 1 wherein the side walls and rear wall are a single piece.

4. The carrier of claim 3 wherein the connection means is a flexible or resilient material.

5. The carrier of claim 1 wherein the base member has longitudinal protrusions forming at least two channels in which the wheels of each skate are positioned.

6. The carrier of claim 5 wherein the base member has a plurality of transverse ribs extending between the longitudinal protrusions.

7. The carrier of claim 1 wherein the base member, side walls and rear wall are made of plastic.

* * * * *

UNITED STATES PATENT AND TRADEMARK OFFICE

CERTIFICATE OF CORRECTION

PATENT NO. : 6,010,172
DATED : January 4, 2000
INVENTOR(S) : Victor J. Comeau

It is certified that error appears in the above-identified patent and that said Letters Patent is hereby corrected as shown below:

On the title page: Item [56] References:

Jung Patent No. should be - - 3,777,956 - - .

Signed and Sealed this

Twenty-eighth Day of November, 2000

*Attest:*

Q. TODD DICKINSON

*Attesting Officer*

*Director of Patents and Trademarks*